US007441425B2

(12) United States Patent
Jeong

(10) Patent No.: US 7,441,425 B2
(45) Date of Patent: Oct. 28, 2008

(54) DOOR LOCK OF CARGO CONTAINER HAVING BURGLARPROOF FUNCTION

(76) Inventor: Kum-Sik Jeong, 106-613, Hyupsung-Phoenix Town, 560-14, Buam-dong, Busanjin-gu, Busan (KR) 614-090

( * ) Notice: Subject to any disclaimer, the term of this patent is extended or adjusted under 35 U.S.C. 154(b) by 0 days.

(21) Appl. No.: 11/806,627

(22) Filed: Jun. 1, 2007

(65) Prior Publication Data

US 2008/0078222 A1 Apr. 3, 2008

(30) Foreign Application Priority Data

Sep. 28, 2006 (KR) ..... 2006-94822
Dec. 12, 2006 (KR) ..... 2006-126626

(51) Int. Cl.
*E05B 67/38* (2006.01)

(52) U.S. Cl. ..... 70/56; 70/203; 70/212; 292/104; 292/200; 292/202; 292/205; 292/217; 292/218; 292/351; 292/DIG. 21; 292/DIG. 32

(58) Field of Classification Search ..... 70/54–56, 70/201–203, 211, 212, 417; 49/394, 395; 74/548, 555, 556; 16/422, 426; 292/202, 292/259 R, 104, 241, DIG. 32, DIG. 21, 200, 292/205, 218, 217, 350, 351
See application file for complete search history.

(56) References Cited

U.S. PATENT DOCUMENTS 3,313,563 A * 4/1967 Hallberg ..... 292/1
4,564,230 A * 1/1986 Haist ..... 292/218
4,581,907 A * 4/1986 Eberly ..... 70/54
4,877,276 A * 10/1989 Pastva ..... 292/218
4,898,008 A * 2/1990 Eberly ..... 70/56
5,016,393 A * 5/1991 Weinerman ..... 49/395
5,718,466 A * 2/1998 Weinerman et al. ..... 292/218
6,233,984 B1 * 5/2001 Blehi, III ..... 70/34
6,527,312 B1 * 3/2003 Jackovino et al. ..... 292/282
6,860,530 B2 * 3/2005 Senn ..... 292/285

FOREIGN PATENT DOCUMENTS

KR 10-0425540 3/2004
WO WO-2004/014764 A1 2/2004

* cited by examiner

*Primary Examiner*—Lloyd A Gall
(74) *Attorney, Agent, or Firm*—Birch, Stewart, Kolasch & Birch, LLP

(57) ABSTRACT

An improved door lock of a cargo container having a burglarproof function is disclosed. The door lock includes a handle hub, in which supporting pieces are integrally formed, welded to a locking rod, a rear supporting piece of the supporting pieces having a fastening hole, a front supporting piece of the supporting pieces integrated with an inward locking protrusion having a screw coupling groove, a handle including a connecting part and having a locking recess with a fastening hole such that the inward locking protrusion of the front supporting piece is inserted into and locked in the fastening hole due to pivot of the handle, and a bolt fastened into the screw coupling groove through the fastening hole of the rear supporting piece. Therefore, robbery is prevented and tamper-evident is easily checked during transfer of the cargo container so that measure against the tamper-evident can be easily taken.

8 Claims, 9 Drawing Sheets

DOOR LOCK OF CARGO CONTAINER HAVING BURGLARPROOF FUNCTION

BACKGROUND OF THE INVENTION

1. Field of the Invention

The present invention relates to a door lock of a cargo container, and more particularly, to an improved door lock of a cargo container having a burglarproof function and to easily check a tamper-evident of the container during the transportation of cargo containers.

2. Description of the Related Art

In general, a cargo container is widely used as a device to transport cargos, and particularly, cargos are accommodated in a container and the container is transported by a ship when the cargos are imported from foreign countries or exported to foreign countries. When the cargos are transported by a ship, since the containers have to wait for the shipping in a container port for a long time and it takes a long time for the transportation of the containers after the shipping, there is a considerable risk of the cargos accommodated in the containers to be robbed during the transportation and robbery cases frequently occur actually.

Furthermore, since burglars ingeniously disguise a door lock of the container after robbing the cargos in the container such that an evidence of robbery is so hardly found with the naked eye that the fact of robbery is not perceived for a long time after the robbery of the cargos.

For this reason, there are continuous efforts to prevent burglar accidents and to easily check tamper-evident of the door lock caused by the robbery. As an example of the efforts, there is Korean Patent No. 10-0425540, filed with Korean Intellectual Property Office (KIPO) by the applicant of this application and registered in 2004, entitled "Cargo Container Door Lock With Theft Prevention Means." Moreover, there is a PCT Application No. WO 2004/014764 A1, filed based on the Korean Patent Application claiming a conventional priority and published in 2004 entitled "Cargo Container Door Lock With Theft Prevention Means."

According to the cargo container door lock disclosed in Korean Patent No. 10-0425540 and PCT Publication No. WO 2004/014764 A1, since a thief must cut a sealed fastening strap (container seal) in order to open a container door, the tamper-evident can be directly confirmed when the container door is opened by force.

However, according to the cargo container door lock, since a handle and a handle hub are coupled by a rivet, if a thief cuts the rivet off with a grinder or makes a hole with a drilling machine, the cargos in the cargo container may be robbed. The thief may rob the cargos and may ingeniously disguise the rivet after robbery. In a state of being innocent of the fact that the broken door lock is disguised with a new rivet, a person in charge at the time when the cargos are robbed does not bear the responsibility for the robbery but a person who release the sealed door lock when the sealed fastening strap (container seal) is released. Therefore, due to this, it may give rise to a trouble of making clear where the responsibility lies.

If the door lock of a cargo container were implemented such that a thief cannot cut the door lock off with a grinder or make a hole with a drilling machine and it is hard to disguise the door lock, it may be effective to prevent the robbery.

SUMMARY OF THE INVENTION

Therefore, the present invention has been made in view of the above and/or other problems, and it is an aspect of the present invention to provide a door lock of a cargo container having an improved burglarproof function available for preventing robbery of cargos accommodated in the cargo container.

It is another aspect of the present invention to provide a door lock of a cargo container having a burglarproof function of preventing a thief from cutting the door lock off with a grinder or from making a hole with a drilling machine and of making the door lock be disguised by the thief.

In accordance with the present invention, the above and other objects can be accomplished by the provision of a door lock of a cargo container having a burglarproof function comprising: a handle hub, in which a pair of supporting pieces is integrally formed, welded to a side of a locking rod; a rear supporting piece of the supporting pieces having a fastening hole; a front supporting piece of the supporting pieces integrally formed with an inward locking protrusion having a screw coupling groove; a handle including a connecting part formed at a side thereof and having a locking recess with a fastening hole such that the inward locking protrusion of the front supporting piece is inserted into and locked in the fastening hole due to pivot of the handle; and a bolt fastened into the screw coupling groove through the fastening hole of the rear supporting piece.

BRIEF DESCRIPTION OF THE DRAWINGS

These and/or other objects and advantages of the present invention will become apparent and more readily appreciated from the following description of the embodiments, taken in conjunction with the accompanying drawings, in which.

DESCRIPTION OF THE PREFERRED EMBODIMENTS

Hereinafter, an apparatus according to embodiments of the present invention will be described in detail with reference to the accompanying drawings. In the following description of the present invention, if the detailed description of the already known structure and operation may confuse the subject matter of the present invention, the detailed description thereof will be omitted.

Figure 1:
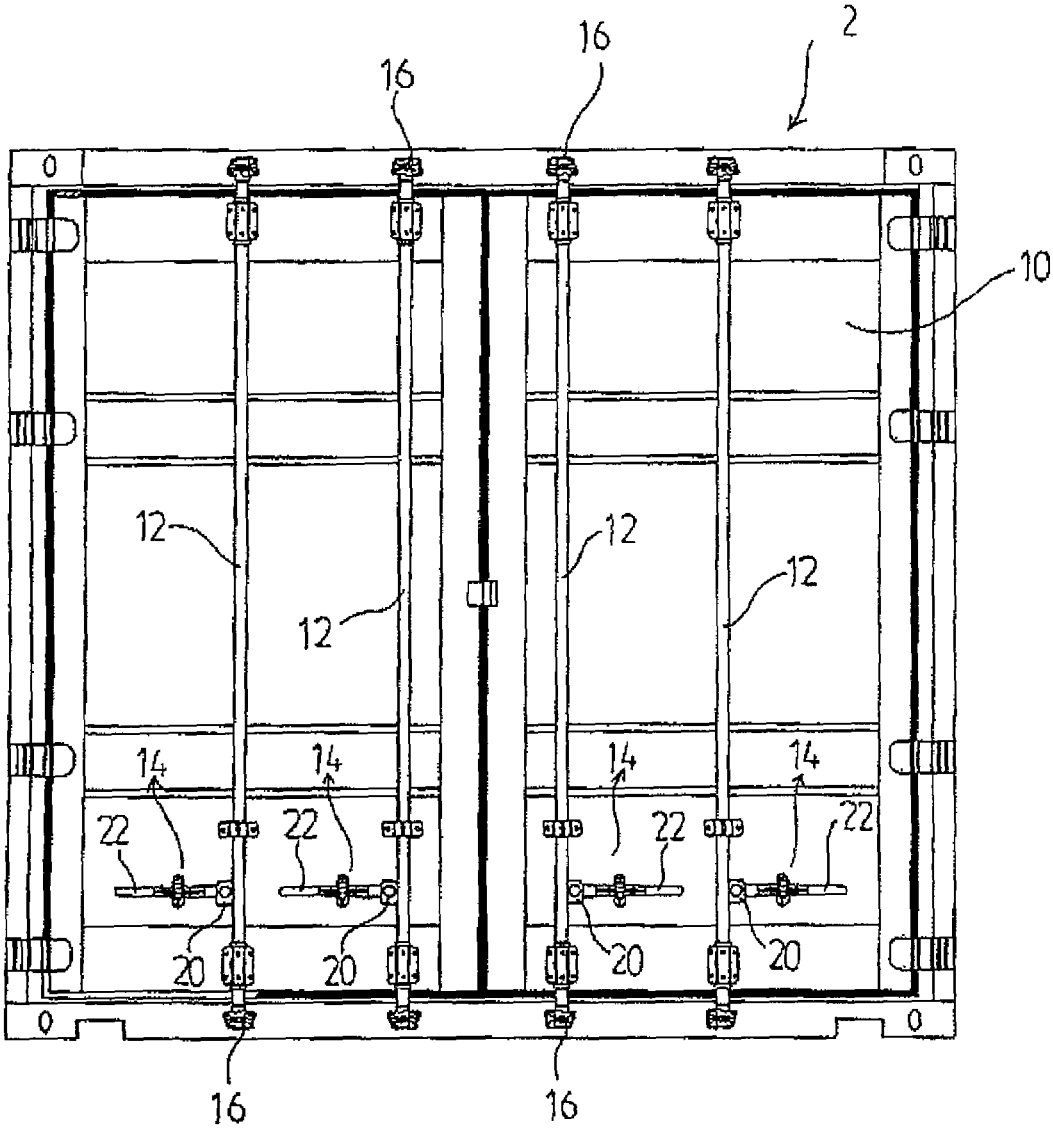
FIG. 1 is a view illustrating a use of a cargo container employing a door lock of a cargo container according to an embodiment of the present invention.

FIG. 1 is a view illustrating a use of a cargo container 2 employing a door lock 14 of a cargo container according to an embodiment of the present invention.

The door lock 14 of a cargo container (hereinafter, referred to as a "fastener") according to the embodiment of the present invention, as illustrated in FIG. 1, is mounted to a side of a locking rod 12 installed to open and close a door 10 of the cargo container 2. A reference numeral 16 of FIG. 1 is assigned to a lock.

Figure 2:
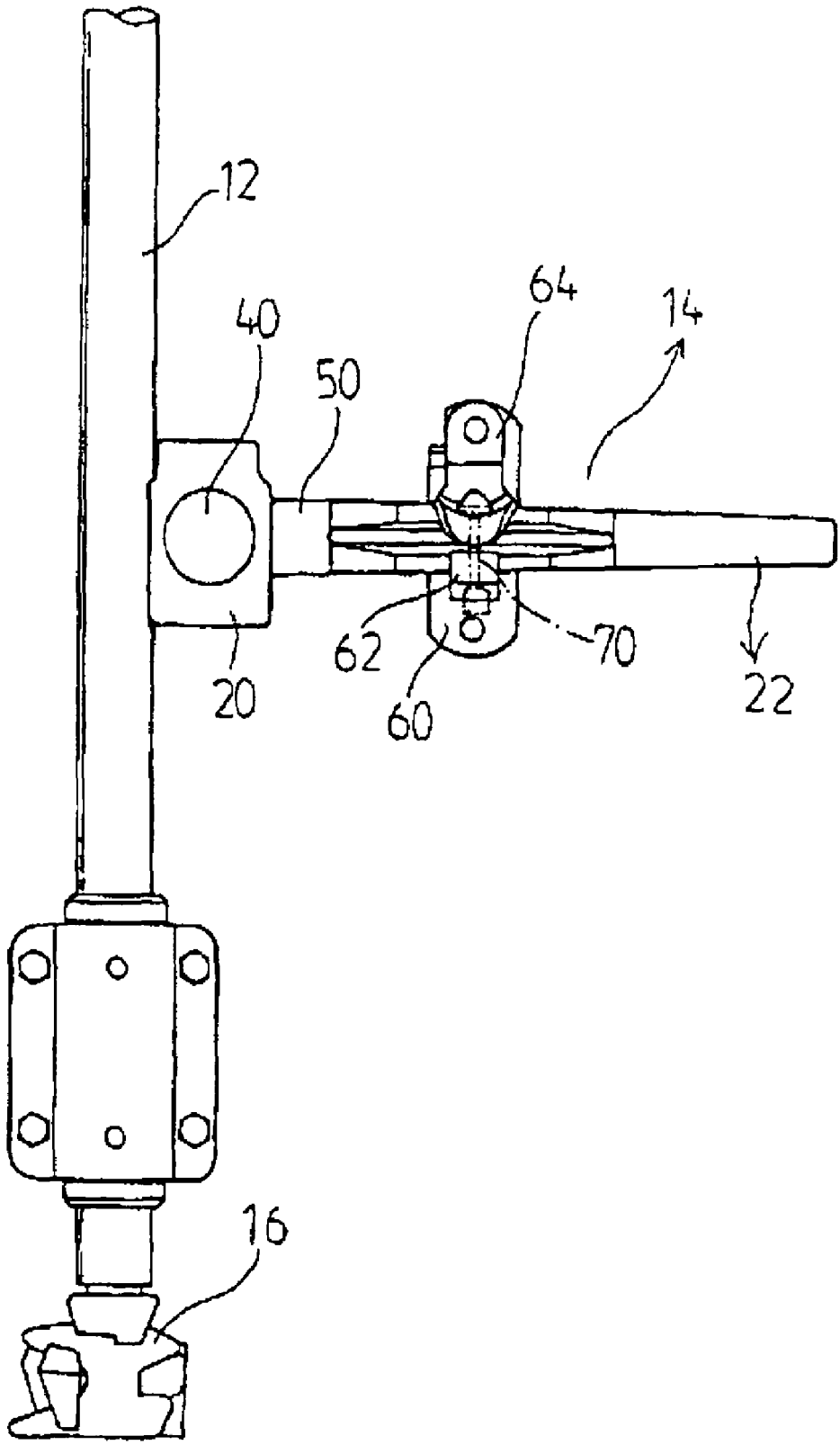
FIG. 2 is a front view illustrating the door lock of a cargo container according to an embodiment of the present invention.
Figure 3:
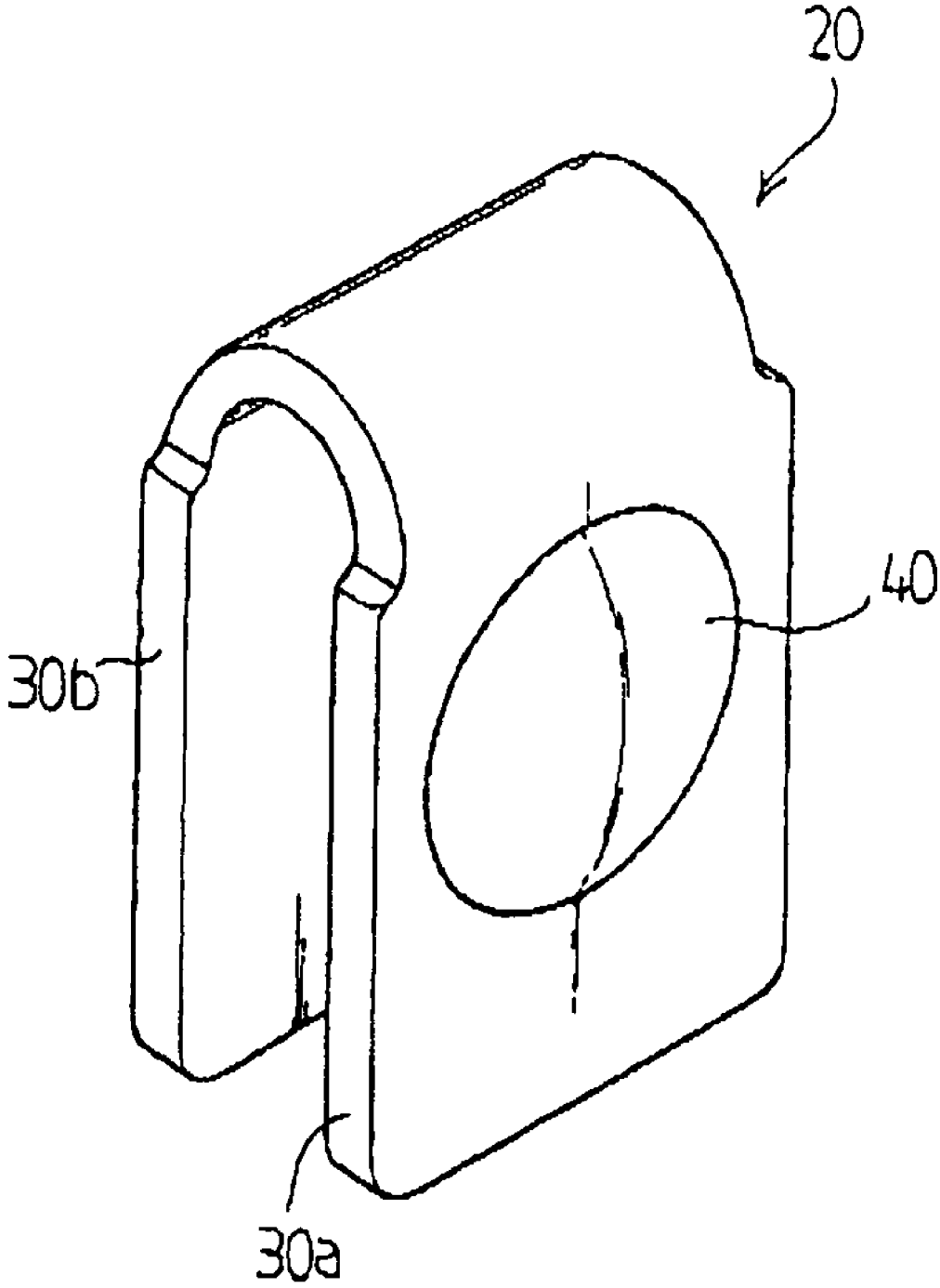
FIG. 3 is a perspective view illustrating a handle hub in FIG. 2.
Figure 4:
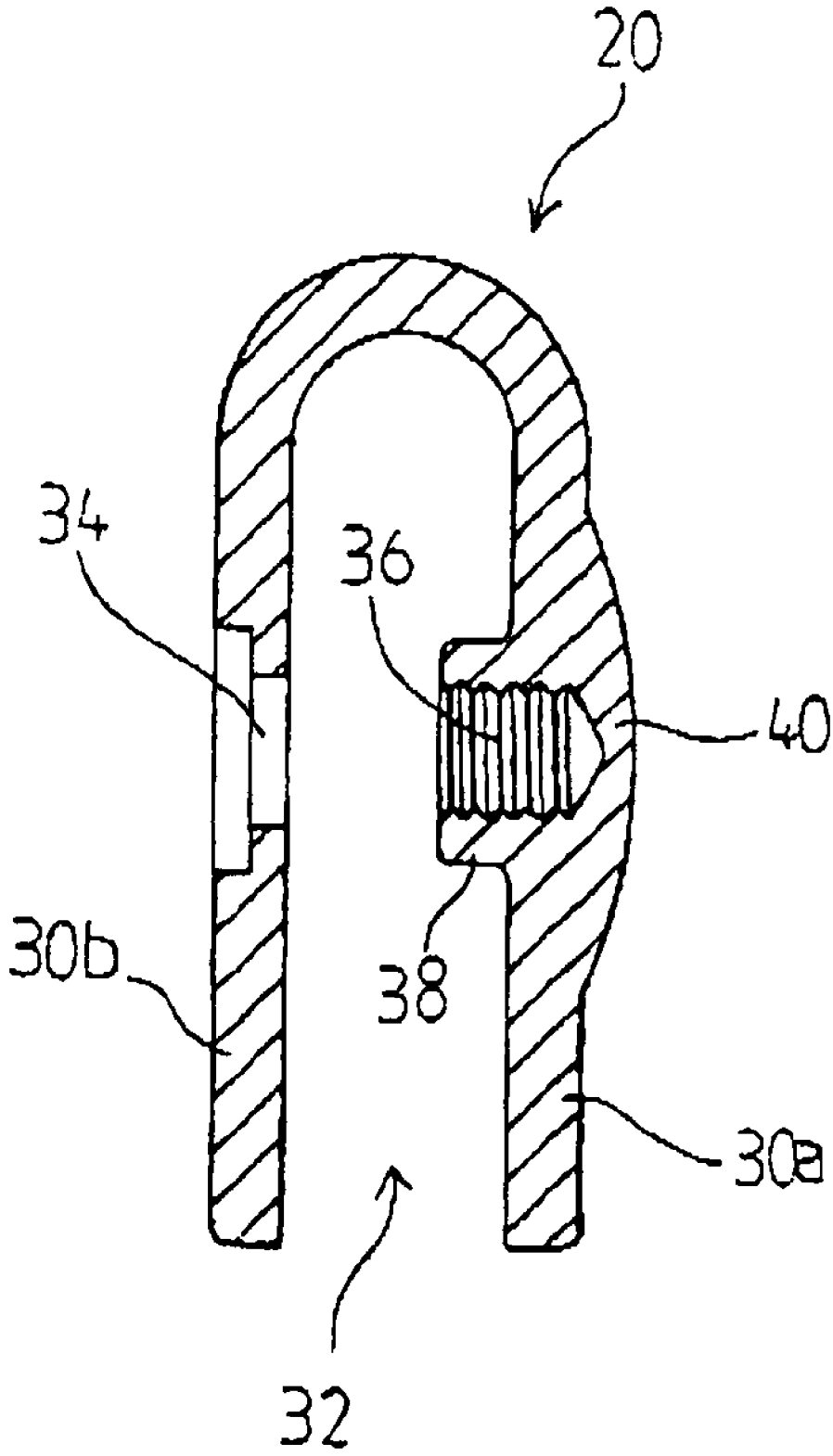
FIG. 4 is a sectional view illustrating the handle hub in FIG. 3.
Figure 5:
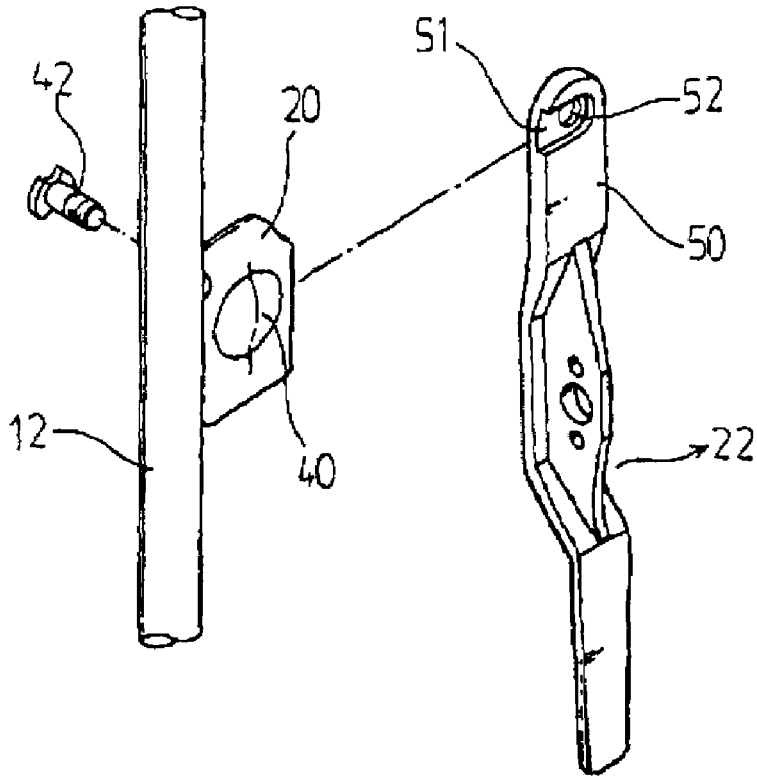
FIG. 5 is a perspective view illustrating the coupling between the handle hub and a handle.
Figure 6:
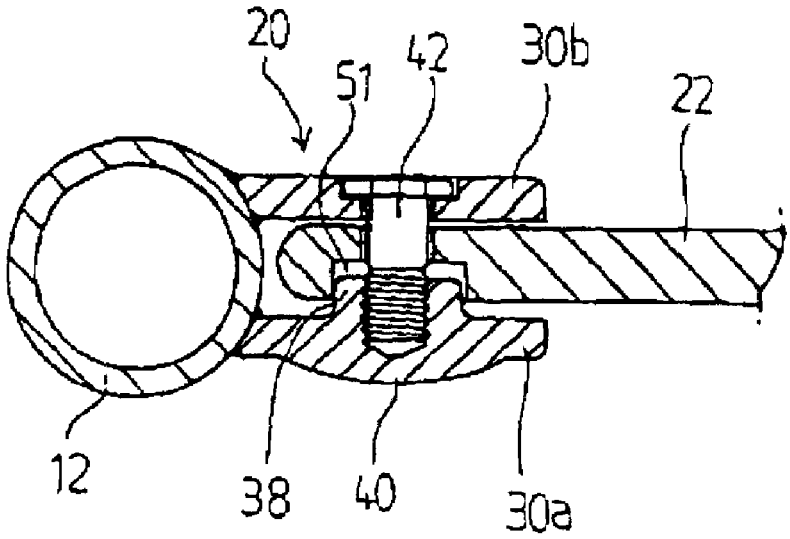
FIG. 6 is a plan sectional view illustrating a main part of the handle hub in a state of coupling the handle with the handle hub.

FIG. 2 is an enlarged front view illustrating the door lock 14 of a cargo container according to an embodiment of the present invention, FIG. 3 is a perspective view illustrating a handle hub 20 in FIG. 2, FIG. 4 is a sectional view illustrating the handle hub 20, FIG. 5 is a perspective view illustrating the coupling between the handle hub 20 and a handle 22, and FIG. 6 is a plan sectional view illustrating a main part of the handle hub 20 in a state of coupling the handle 22 with the handle hub 20.

Referring to FIGS. 2 to 6, the door lock 14 according to the embodiment of the present invention, as illustrated in FIG. 2, includes the handle hub 20 welded to a side of the locking rod 12. The handle 22 is coupled with the handle hub 20 in such a way that a connecting part 50 provided at a side of the handle 22 is coupled with the handle hub 20. A central portion of the handle 22 is locked by a locking piece 62 and a catch 64 of a fixing plate 60 that is fixed to an outer surface of a door 10 of the cargo container 2 and coupled with the fixing plate 60.

The handle hub 20 has a material characteristic and a structural property such that a fastening bolt 42 cannot be perforated or cut off by a grinder or a drilling machine. Moreover, the handle hub 20 has a configuration such that, even if a main body is perforated or cut off, it is hard for a thief to disguise the main body due to the robbery trace. The coupling between the handle hub 20 and the handle 22 has a structural property such that, even if the bolt 42 of the handle hub 20 is cut off, the handle 22 is unable to be released from the handle hub 20 without releasing a container seal 70.

In more detail, the handle hub 20 of the present invention, as illustrated in FIGS. 3 and 4, is configured in a way that a tungsten carbide plate of high carbon steel having a predetermined thickness is bent to have a U-shape by a forging press such that a pair of supporting pieces 30*a* and 30*b*, which face each other and are integrally formed with each other, is formed and an insertion portion 32 is defined therebetween.

A rear supporting piece 30*b* of the pair of supporting pieces 30*a* and 30*b* of the handle hub 20 has a fastening hole 34 formed in the central portion thereof, and a front supporting piece 30*a* includes an inward locking protrusion 38 having a screw coupling groove 36 formed at the rear central portion. A protrusion 40 is integrally with the front portion of the front supporting piece 30*a*.

On the other hand, the handle 22 coupled with the handle hub 20, as illustrated in FIG. 5, has a locking recess 51 formed in the connecting part 50 and having a fastening hole 52 such that the inner locking protrusion 38 of the front supporting piece 30*a* of the handle hub 20 is inserted into the locking recess 51.

The fastening hole 34 and the screw coupling groove 36 of the supporting pieces 30*a* and 30*b* of the handle hub 20 are provided for the fastening of the bolt 42 when the handle 22 is coupled with the handle hub 20. The inner locking protrusion 38, as illustrated in FIG. 5, is provided to serve as a lock when the inner locking protrusion 38 is inserted into the locking recess 51 of the connecting part 50 of the handle 22 and the handle 22 is pivoted.

When the handle 22 is inserted into the handle hub 20 and is pivoted, the handle 22 is locked and fixed by the handle hub 20 and the bolt 42 fastened at the rear side of the handle hub 20 is not exposed over the front side of the handle hub 20 after the bolt 42 is fastened. Particularly, the protrusion 40 formed at the front central portion of the front supporting piece 30*a* is provided such that a thief cannot perforate the front supporting piece 30*a* with a cutting machine such as a drilling machine and the handle hub 20 is made of a tungsten carbide plate of high carbon steel so that it is next to impossible for the thief to perforate with the cutting machine such as the drilling machine.

Figure 9:
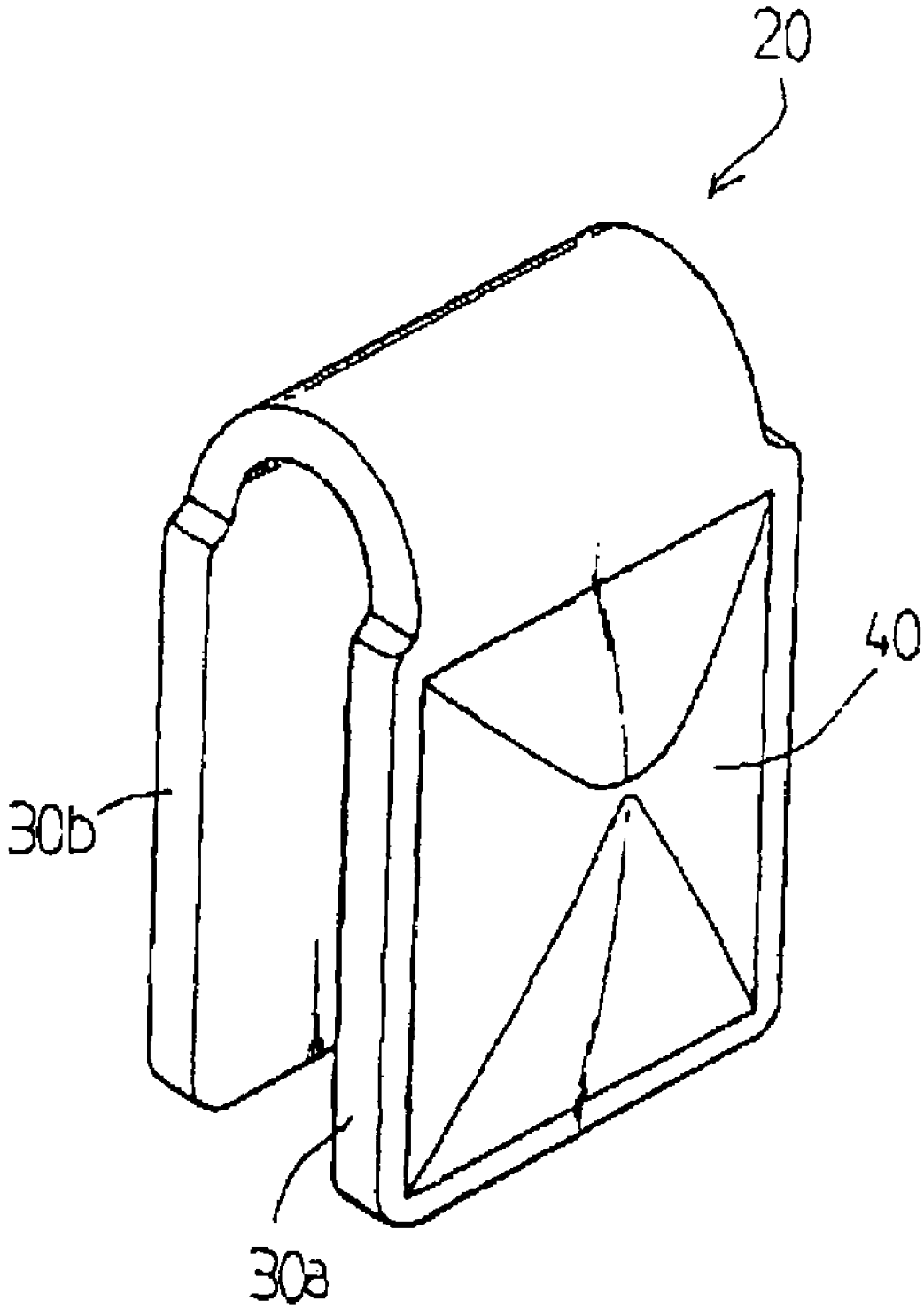
FIGS. 9 and 10 are perspective views illustrating modifications of the handle hub in FIG. 2.
Figure 10:
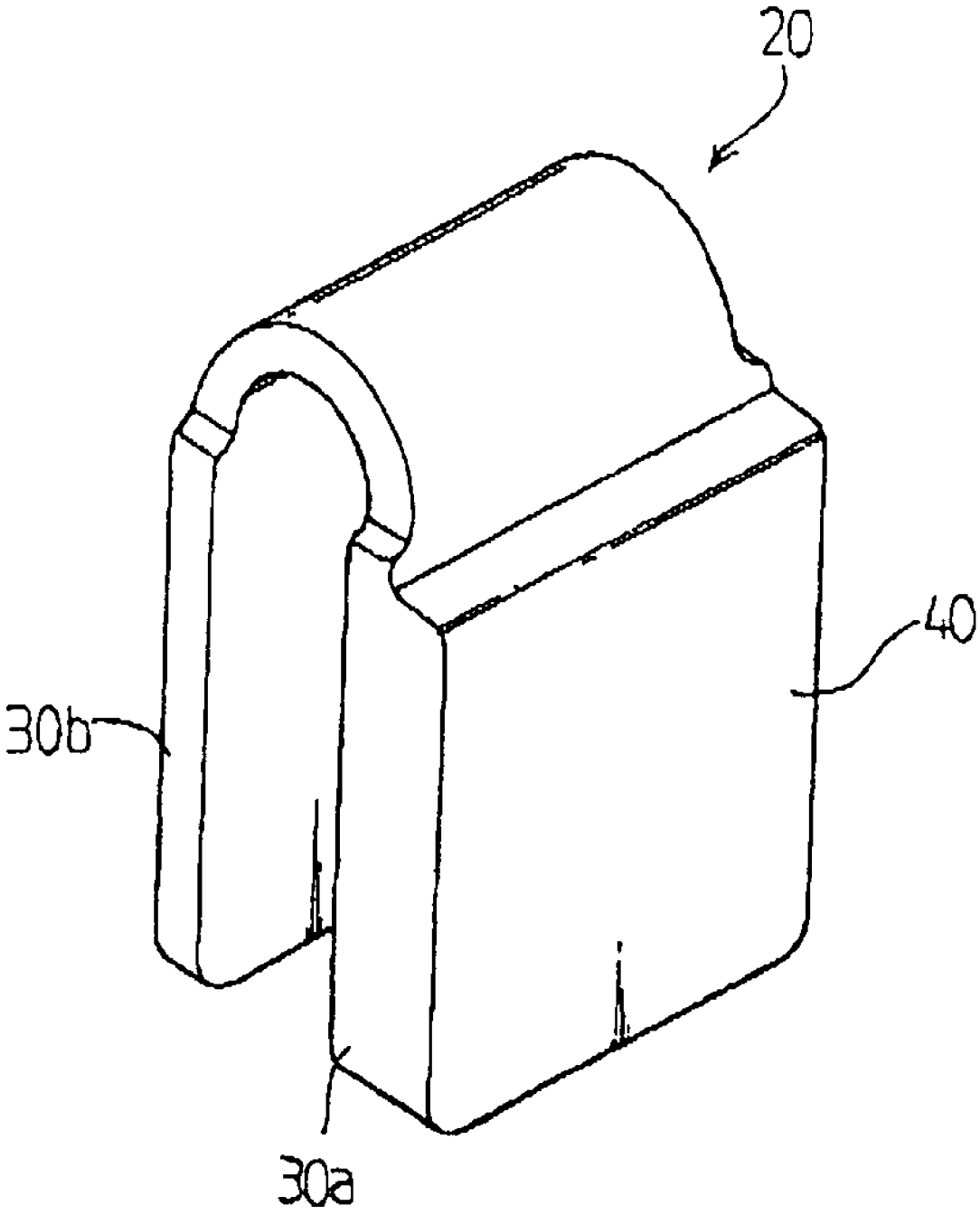

In the embodiment of the present invention, the protrusion 40 integrally formed with the front central portion of the front supporting piece 30*a* of the handle hub 30, as illustrated in FIG. 3, may be formed on the front supporting piece 30*a* in the form of a dome shape, or, as illustrated in FIG. 9, on the front supporting piece 30*a* in the form of a curved cone shape. Moreover, the protrusion 40 may be protruded from the front supporting piece 30*a* in the form of a plate having the same size as the front supporting piece 30*a* as illustrated in FIG. 10.

The protrusion 40 having the above-mentioned shapes makes a drill bit more likely to slide on the protrusion 40 or has a thickness so as to be impossible to perforate with the drill bit.

The coupling of the handle 22 to the handle hub 20 will be described in detail with reference to FIGS. 5 to 7 as follows.

When coupling the handle 22 with the handle hub 20, firstly the handle 22 is vertically erected, the connecting part 50 of the side of the handle 22 is inserted into the insertion portion 32 of the handle hub 20 such that the inner locking protrusion 38 of the front supporting piece 30*a* is inserted into the locking recess 51 of the connecting part 50. By doing so, the fastening hole 52 of the connecting part 50 is naturally aligned with the fastening hole 34 of the rear supporting piece 30*b*. In this state, as illustrated in FIG. 5, the bolt 42 is inserted into the fastening hole 34 of the rear supporting piece 30*b* from the rear side of the handle hub 20 and is fastened into the screw coupling groove 36 of the front supporting piece 30*a*. Moreover, if necessary, a head of the bolt 42 is welded in a recess in which the head of the bolt 42 is placed such that the bolt 42 is welded to the rear supporting piece 30*b*.

Figure 7:
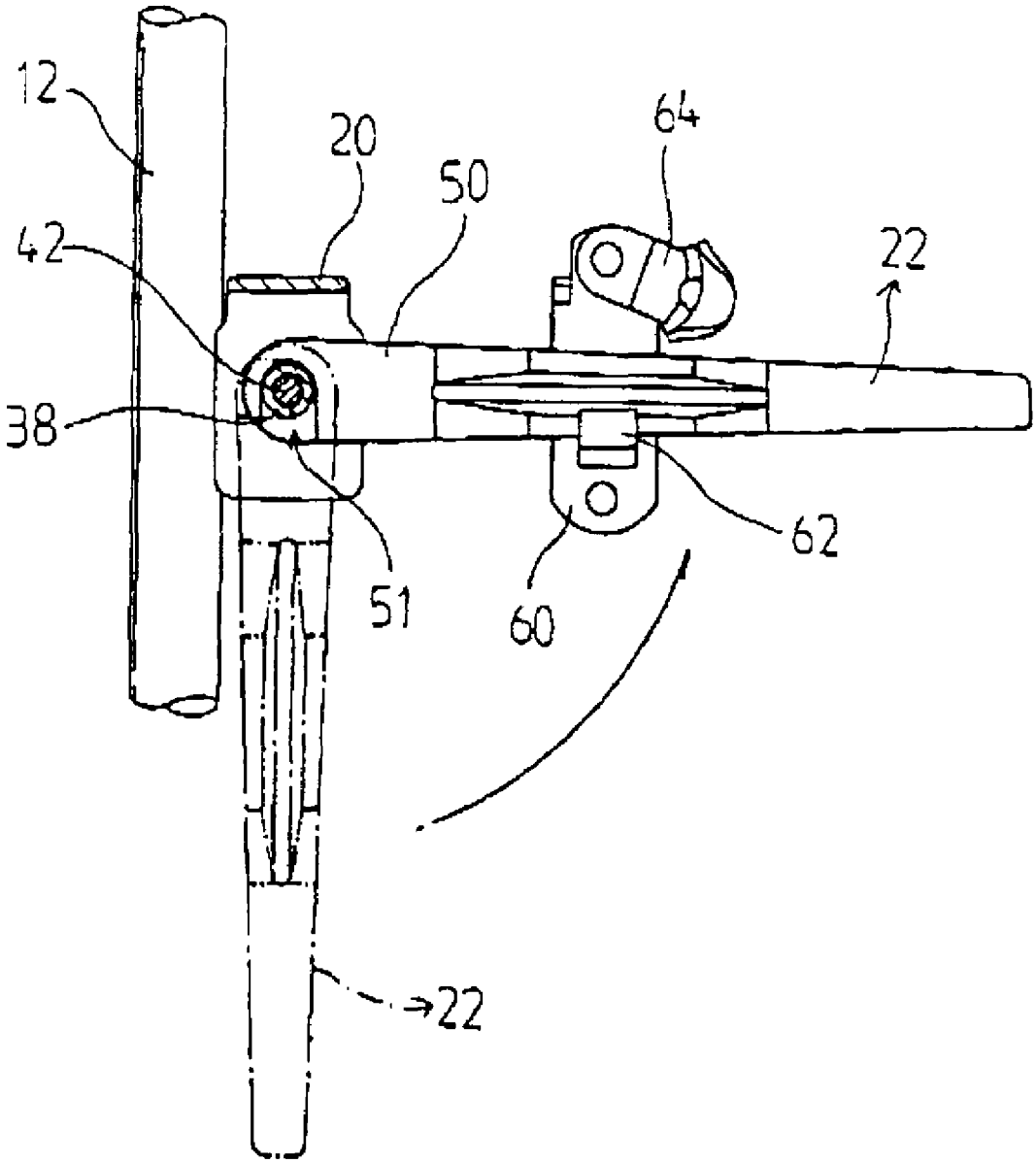
FIG. 7 is a view illustrating a final process of the coupling of the handle.

As described above, after the handle 22 is coupled, the handle 22 is pivoted toward the door 10 about the locking rod 12 to contact the door 10 and the handle 22 vertically hung is pivoted up counterclockwise, as illustrated in FIG. 7, to be locked by the locking piece 62 of the fixing plate 60 fixed to the outer surface of the door 10. Next, the catch 64 is so pivoted that the central portion of the handle 22 is locked by the locking piece 62 and the catch 64 of the fixing plate 60.

Figure 8:
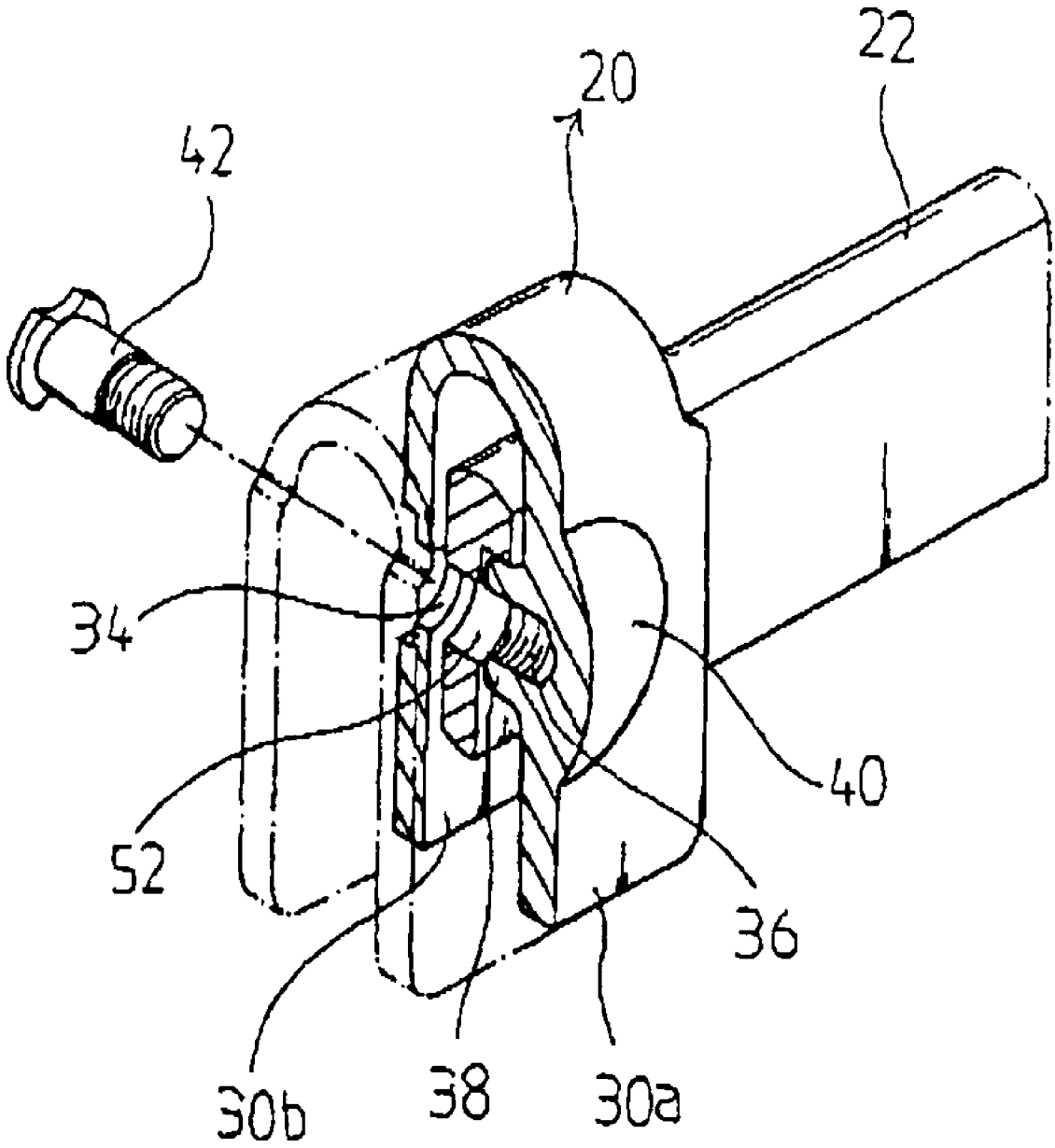
FIG. 8 is a partial sectional perspective view illustrating the handle hub with which the handle is coupled.

The fastened and locked state of the handle 22 to the handle hub 20 and by the fixing plate 60 can be clearly understood with reference to FIGS. 6 to 8. In other words, since the locking recess 51 formed at the connecting part 50 of the handle 22 is downwardly opened, although the bolt 42 of the handle hub 20 is perforated or cut off, the inward locking protrusion 38 of the front supporting piece 30*a* is still locked by the locking recess 51. Thus, a thief cannot detach the handle 22 from the handle hub 20 without releasing the container seal 70.

According to this embodiment of the present invention, since a thief may cut the catch 64 off with a cutting tool, it is preferable that the catch 64, like the case of the handle hub 20, is made of tungsten carbide of high carbon steel and has a thickness of 5 mm to 10 mm.

After the handle 22 is locked by the locking piece 62 and the catch 64 of the fixing plate 60, a user welds the container seal 70 penetrating the catch 64 and the handle 22 to seal the handle 22. There are various types of container seals 70 such as a bolt, a nut, a fastening strap, and other known types. It is preferable that the container seal 70 is made of high carbon steel, like the case of the handle hub 20.

In this configuration, it is difficult for the thief to perforate or cut the handle hub 20 and to cut the catch 64 and the container seal 70 too.

As described above, according to the present invention, since a thief cannot cut or perforate the door lock of a cargo container with a grinder or a drilling machine, the cargos in the cargo container can be prevented from robbing. Moreover, in addition to the function of preventing robbery, the tamper-evident is easily checked during the transportation of the cargo container so that a measure against the tamper-evident can be easily taken.

Although, in the preferred embodiment of the present invention, the inward locking protrusion 38 is formed in the handle hub 20 in which a pair of supporting pieces 30*a* and 30*b* are integrally formed with each other and the locking recess 51 is formed in the connecting part 50 of the handle 22 such that the handle 22 is inserted into the handle hub 20 and pivots to be locked by the handle hub 20, on the contrary, it is possible that the locking recess 51 is formed in the handle hub 20 and the inward locking protrusion is formed in the connecting part 50 of the handle 22. Moreover, although the fastening hole 34 and the screw coupling groove 36 are formed in the handle hub 20 to couple the bolt 42, those skilled in the art appreciate that the handle hub 20 can be configured without the bolt 42, the fastening hole 34, and the screw coupling groove 36.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A door lock of a cargo container having a burglarproof function comprising:

a handle hub, in which a pair of supporting pieces is integrally formed, welded to a side of a locking rod;

a rear supporting piece of the supporting pieces having a fastening hole;

a front supporting piece of the supporting pieces integrally formed with an inward locking protrusion having a screw coupling groove;

a handle including a connecting part formed at a side thereof and having a locking recess with a fastening hole such that the inward locking protrusion of the front supporting piece is inserted into and locked in the locking recess due to pivot of the handle; and a bolt fastened into the screw coupling groove through the fastening hole of the rear supporting piece.

2. The door lock of a cargo container having a burglarproof function according to claim 1, wherein the handle hub is made of a high carbon steel.

3. The door lock of a cargo container having a burglarproof function according to claim 1 or 2, wherein the front supporting piece of the handle hub further comprises a protrusion integrally formed with a front side of the front supporting piece.

4. The door lock of a cargo container having a burglarproof function according to claim 3, wherein the protrusion is protruded from the front supporting piece in the form of a dome shape.

5. The door lock of a cargo container having a burglarproof function according to claim 3, wherein the protrusion is protruded from the front supporting piece in the form of a curved cone shape.

6. The door lock of a cargo container having a burglarproof function according to claim 3, wherein the protrusion is protruded from the front supporting piece in the form of a plate.

7. The door lock of a cargo container having a burglarproof function according to claim 1, further comprising a fixing plate installed to a door of the cargo container, wherein the handle, in which the connecting part is fastened to the handle hub by the bolt, is locked by a locking piece and a catch of the fixing plate, and the catch has a thickness of 5 mm to 10 mm and is made of a high carbon steel.

8. A door lock of a cargo container having a burglarproof function comprising:

a handle hub, in which a pair of supporting pieces is integrally formed, welded to a side of a locking rod;

a handle pivotally connected to the handle hub, a handle locking device having a locking protrusion integrally formed in one of the pair of supporting pieces, the locking protrusion having a locking groove formed therein, and a connecting part formed at a side of the handle such that the connecting part of the handle is inserted between the pair of supporting pieces to allow the handle to pivot to be locked; and a locking piece formed on a fixing plate fixed to a door to lock an opposite side of the handle when the handle is locked.

* * * * *